US008794409B2

(12) United States Patent
Klevana et al.

(10) Patent No.: US 8,794,409 B2
(45) Date of Patent: Aug. 5, 2014

(54) TRAVEL COVER WITH A SWIVEL HANDLE

(75) Inventors: Leighton Klevana, Richmond, VA (US); Ed Miyashita, Glen Allen, VA (US)

(73) Assignee: Dynamic Brands, LLC, Richmond, VA (US)

( * ) Notice: Subject to any disclaimer, the term of this patent is extended or adjusted under 35 U.S.C. 154(b) by 305 days.

(21) Appl. No.: 13/181,564

(22) Filed: Jul. 13, 2011

(65) Prior Publication Data

US 2013/0015030 A1 Jan. 17, 2013

(51) Int. Cl.
*A45C 5/14* (2006.01)
*A45C 13/26* (2006.01)

(52) U.S. Cl.
USPC ..... 190/18 A; 190/26; 190/39; 190/115; 16/114.1

(58) Field of Classification Search
USPC ..... 190/18 A, 39, 115, 26; 16/113.1, 114.1, 16/414, 433; 220/696, 752
See application file for complete search history.

(56) References Cited

U.S. PATENT DOCUMENTS

| | | | | | |
|---|---|---|---|---|---|
| 588,721 | A * | 8/1897 | Thomas | 190/3 |
| 2,605,989 | A * | 8/1952 | Luft | 248/349.1 |
| 2,784,816 | A * | 3/1957 | Goldberg | 190/115 |
| 2,890,061 | A * | 6/1959 | Watson | 280/47.26 |
| 4,876,416 | A * | 10/1989 | Frantz et al. | 200/11 R |
| 5,464,080 | A * | 11/1995 | Liang | 190/18 A |
| 5,588,569 | A * | 12/1996 | Mitomi et al. | 224/153 |
| 5,813,504 | A * | 9/1998 | Iny et al. | 190/116 |
| 6,164,425 | A * | 12/2000 | Latshaw | 190/18 A |
| 7,077,252 | B2 * | 7/2006 | Sanchez | 190/108 |
| 7,077,266 | B2 * | 7/2006 | Dietrich | 206/315.4 |
| 2005/0126873 | A1 * | 6/2005 | Matsumoto | 190/115 |
| 2005/0241900 | A1 * | 11/2005 | Fisher | 190/115 |

* cited by examiner

*Primary Examiner* — Sue A Weaver
(74) *Attorney, Agent, or Firm* — Pike IP Law, PLLC; Bernard G. Pike

(57) ABSTRACT

Luggage, duffel bags, travel bags and travel covers including travel covers for sporting goods such as, but not limited to, golf bags, skis, snowboards, baseball equipment, soccer equipment, and tennis equipment, and travel covers for trade-show or conference displays or graphics, product samples, tents (collectively, "travel covers"), for example, are commonly used for conveniently transporting and protecting large objects during travel by walking, car, train and/or airplane. The travel covers may have a handle that my rotate or swivel to adjust to an ergonomic position for pulling or pushing the travel cover.

20 Claims, 5 Drawing Sheets

TRAVEL COVER WITH A SWIVEL HANDLE

FIELD OF THE INVENTION

The invention is directed to luggage and travel covers for carrying sports equipment or other objects that need protection during transportation. Embodiments of the travel covers comprise at least one wheel and a handle that is configured to swivel to provide ease and ergonomic handling of the travel cover.

BACKGROUND

Luggage, duffel bags, travel bags and travel covers including travel covers for sporting goods such as, but not limited to, golf bags, skis, snowboards, baseball/softball equipment, soccer equipment, football equipment, lacrosse equipment, hockey equipment, bowling equipment, motocross equipment, and tennis equipment, and travel covers for tradeshow or conference displays or graphics, product samples, tents (collectively, "travel covers"), for example, are commonly used for conveniently transporting and protecting large objects during travel by walking, car, train and/or airplane.

Luggage may have wheels to assist in moving the luggage and its contents. Typical wheeled luggage also has a retractable handle that may be moved between a storage position and an extended position. The handle is pulled out of the storage position into the extended position to increase the overall length of the luggage so it may more easily be rolled. The extended position prevents the user from having to bend over to hold the handle when the luggage is in a tilted position that allows the luggage to roll. Thus, the extended position avoids fatigue and injury to the user.

Some wheeled travel covers, however, are sufficiently long so they do not require a retractable handle. These long travel covers typical have handles attached to the top portion of the travel cover. The handle is attached directly to the enclosure, typically sewn on, and does not swivel relative to the travel cover. The handle is usually attached in a horizontal position that may be uncomfortable to the user of the travel cover but is a compromise position for pulling the travel cover with the right or left hand.

There exists a need for a travel cover with a swivel handle that is attached directly to the enclosure of the travel cover and that swivels. There exists a further need for a travel cover in which the enclosure does not comprise a retractable handle but has a swivel handle.

SUMMARY

Embodiments of the invention are directed to a travel cover with a handle capable of rotating of swiveling. The travel cover comprises an enclosure for protecting and facilitating transporting objects during travel. For example, embodiments of the travel cover comprise an enclosure, a base plate connected to the enclosure, and a handle rotatably connected to the base plate. The travel cover may further comprise a rotatable plate wherein the handle is connected to the rotatable plate. The base plate and the rotatable plate may be any size or shape capable of supporting and connecting the swivel handle on the enclosure. In some embodiments, the base plate or rotatable plate may cover more than fifty percent (50%) of the top portion of the travel cover.

Further embodiments of the travel cover may comprise a housing having a surface defining an aperture, wherein the handle or a portion of the handle protrudes through the aperture and the surface covers a periphery portion of the rotatable plate. The housing may be connected to the enclosure directly or connected to a base plate.

A still further embodiment of the travel cover comprises an enclosure, a housing for the swivel handle, a rotatable plate directly or indirectly connected to the enclosure, the rotatable plate comprising a first side facing toward the enclosure and a second side facing away from the enclosure, and a bearing contacting a bearing surface on the second side of the rotatable plate and a bearing surface on an inside surface of the housing. The swivel handle may comprise more than one bearing to facilitate rotation of the handle.

Other aspects and features of embodiments of the travel covers comprising at least one swivel handle will become apparent to those of ordinary skill in the art, upon reviewing the following description of specific, exemplary embodiments of the present invention in concert with the figures. While features may be discussed relative to certain embodiments and figures, all embodiments can include one or more of the features discussed herein. While one or more particular embodiments may be discussed herein as having certain advantageous features, each of such features may also be integrated into various other of the embodiments of the invention (except to the extent that such integration is incompatible with other features thereof) discussed herein. In similar fashion, while exemplary embodiments may be discussed below as system or method embodiments it is to be understood that such exemplary embodiments can be implemented in various systems and methods.

DESCRIPTION OF EMBODIMENTS

Figure 1:
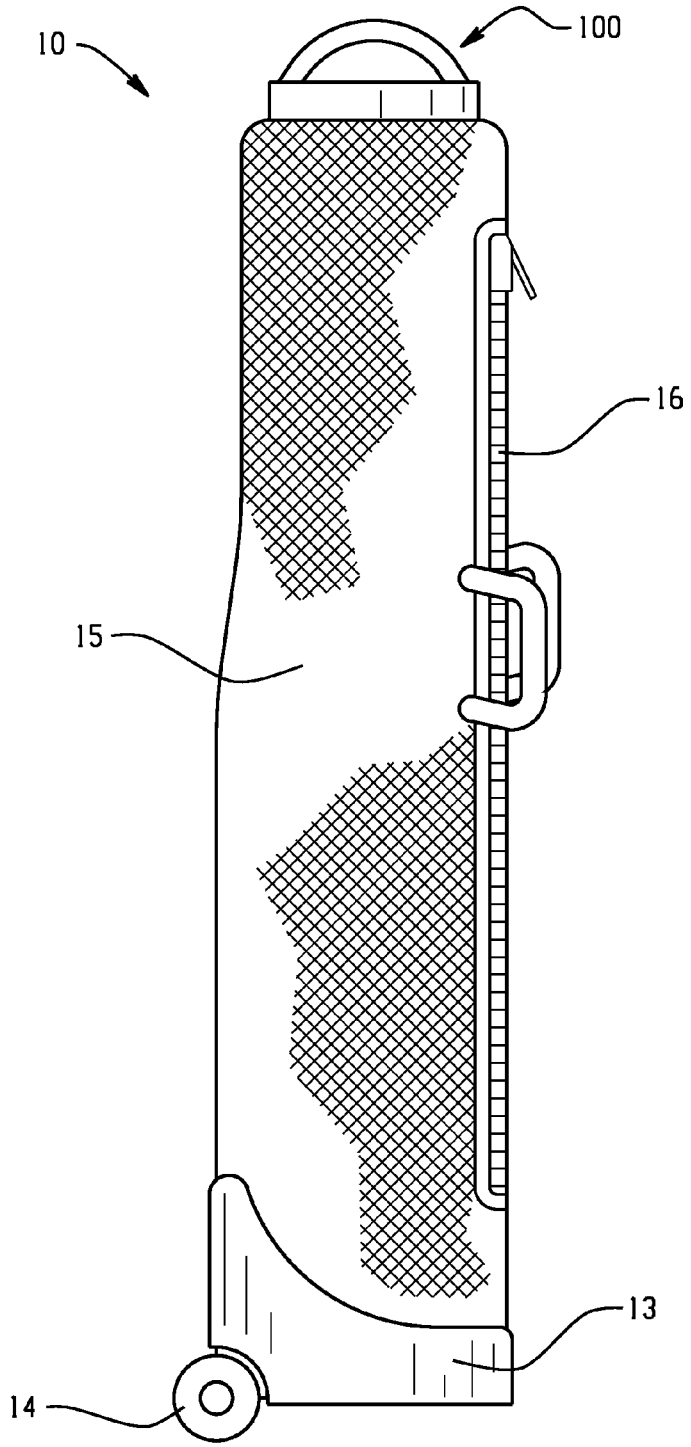
FIG. 1 depicts a travel cover.

Travel covers are used to protect a variety of objects during transport including traveling by walking, car, train and/or airplane as previously described. For example as shown in FIG. 1, a golf bag travel cover may be used to protect a golf bag and golf clubs. Golf bag travel covers are typically used by golfers to protect and ease transporting their golf clubs on airplanes where the bags must be carried through the airport. There is a significant chance of damage to the golf clubs as they are put in a trunk of a car, carried through an airport, and loaded into and transported in a baggage compartment of a train or airplane. These covers have tough enclosures that protect golf bags and other objects to be transported. The enclosures of travel covers may be flexible, rigid, or have components that are rigid and components that are flexible. For example, the embodiment of the golf bag travel cover 10 shown in FIG. 1, includes a rigid base member 13, a pair of wheels 14, a flexible cover 15, and means for closing 16 the flexible cover 15. The means for closing may be selected from the group comprising, but not limited to, zippers, hook and loop closures, buckles, snaps, ties, buttons and/or a combination of such closures. The embodiment of the golf bag travel cover further comprises a swivel handle 100. The swivel handle 100 may rotate to allow ergonomic pulling or pushing of the travel cover by a traveler to the car, through the airport or hotel, to the golf course, as well as anywhere else.

In the embodiment shown in FIG. 1, the base member 13 allows the golf bag travel cover 10 to stand upright and comprises at least one wheel 14 for rolling the travel cover when the travel cover 10 is in the tilted position. The travel cover 10 may be leaned forward to shift the weight onto the wheels 14 and held by the handle 100 on the top portion of the travel cover 10. The travel cover 10 may be easily pulled as a portion of the weight of the travel cover and its contents is supported by the wheels 14 and only a portion of the weight may be supported by a handle by the user. However, as the travel cover 10 is transferred from the user's left hand to the right hand, for example, the swivel handle 100 may adjust by rotating to a comfortable position for the user's hand in the new position. It is ergonomic for the swivel handle 100 to rotate from tilting from a comfortable position for the right hand to a comfortable position in the left hand. The swivel handle 100 may also adjust to reduce stress on the hand, wrist, and/or arm of the user as the travel cover is pulled up stairs, turned around corners or when tilting the travel cover from an upright position to a rolling, tilted, or laying position.

Embodiments of the swivel handle and components of the swivel handle may be made using any material or combination of materials that provides the desired properties to the components. Example materials include plastics such as, but not limited to, ABS, polyethylene, high density polyethylene, polypropylene, or other plastics and metals including, but not limited to, aluminum, steel, stainless steel, or combinations of such materials, for example. Similarly, the flexible portion, if present, may be made using any desired material such as, but not limited to, nylon or other fabric.

As previously stated, typical luggage having wheels will also comprise a retractable handle. The retractable handle may be withdrawn to increase the overall height of the luggage and extend the handle to a more ergonomic height for pulling the luggage on the wheels. With the handle extended, the luggage may be leaned forward with a portion of the weight still supported by the wheels but the user's arm may be comfortably extended to pull the luggage. However, some travel covers are already at sufficient length that the travel cover does not require a retractable handle to extend their overall height. Typically, retractable handles may be extended to increase the overall height of the luggage to the range of about three feet to about four feet. Embodiments of travel covers comprising wheels that have an overall length over three feet may comprise a non-retractable handle fixed handle. Other embodiments of the travel cover having an overall length of three and one half feet or greater, or even four feet or greater may not have a retractable handle. These embodiments of travel covers may comprise a non-retractable handle that is typically fixed to a top portion of the travel cover.

Embodiments of the travel cover comprising a non-retractable handle capable of swiveling about an axis during use. Components of an embodiment of the swivel handle 100 capable of swiveling are shown in FIG. 2.

The rotatable plate may be any portion or component connected to the handle that is used to rotatably connect the handle to the top portion of the enclosure. In the embodiment shown in FIG. 2, the rotatable plate is a circular plate that rotates within the housing. However, the rotatable plate is not required to be complete circle, for example, the rotatable plate may be an annular ring; two small place plates attached, one attached to each end of the handle, a plate extending between both ends of the handles, as well as generally triangular, square, rectangular, oval or other shapes.

The rotatable plate may be sandwiched between the other components of the travel cover such as between any combination of a housing, a bearing, fixed or non-rotatable plate, the enclosure, or two of the same types of components. The rotatable plate may also be rotatably connected by an axle, center shaft or central connector. The axle, center shaft or central connector may further include a bearing. Thus, the rotatable plate may be rotatably connected to the travel cover by its center, its periphery, or both. In any case, the bearings may be integral or separate from another component.

Figure 2:
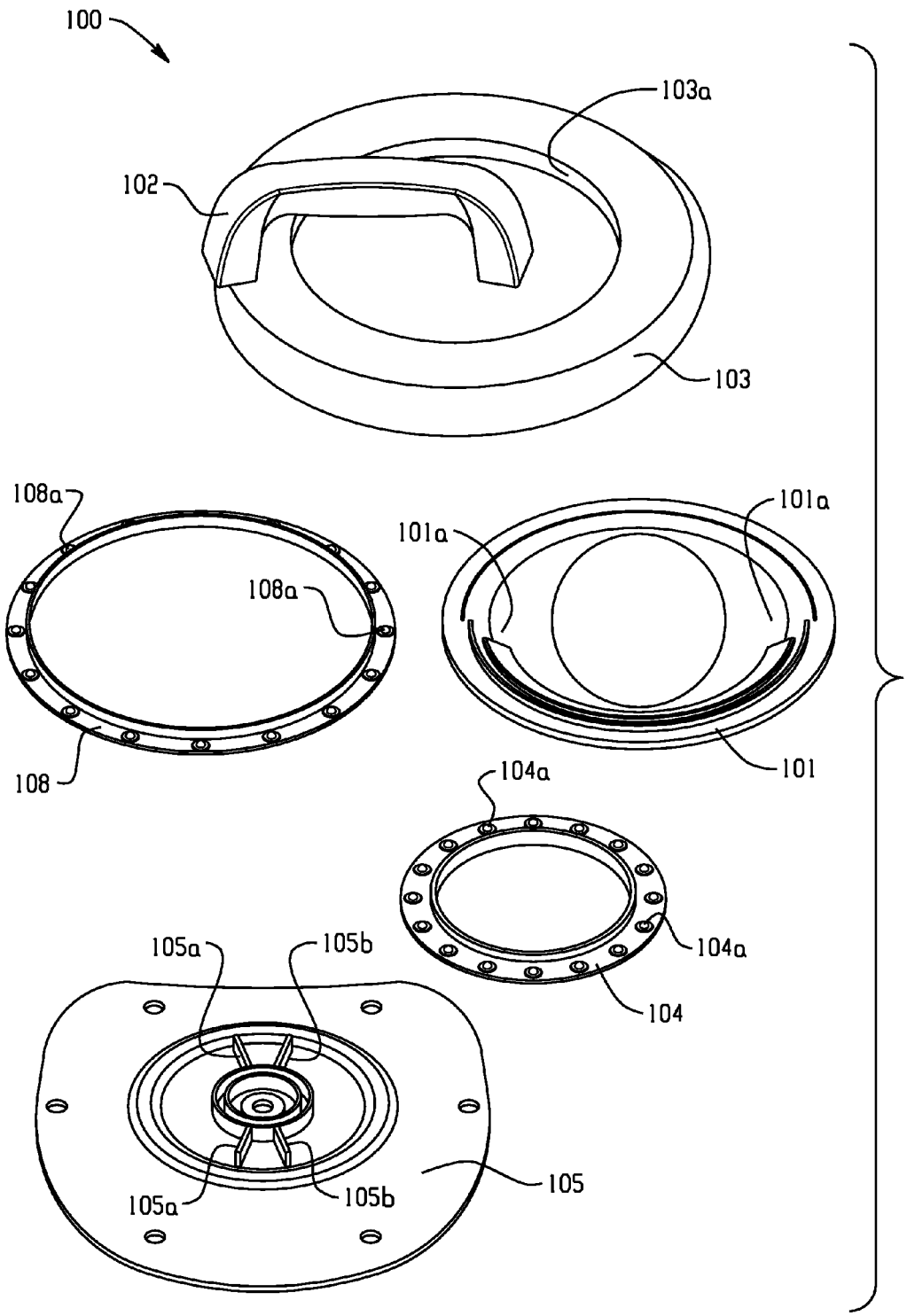
FIG. 2 depicts components of an embodiment of a travel cover comprising a swivel handle including an upper bearing 108, rotatable plate 101, lower bearing 104, base plate 105, housing 103 and handle 102.
Figure 4:
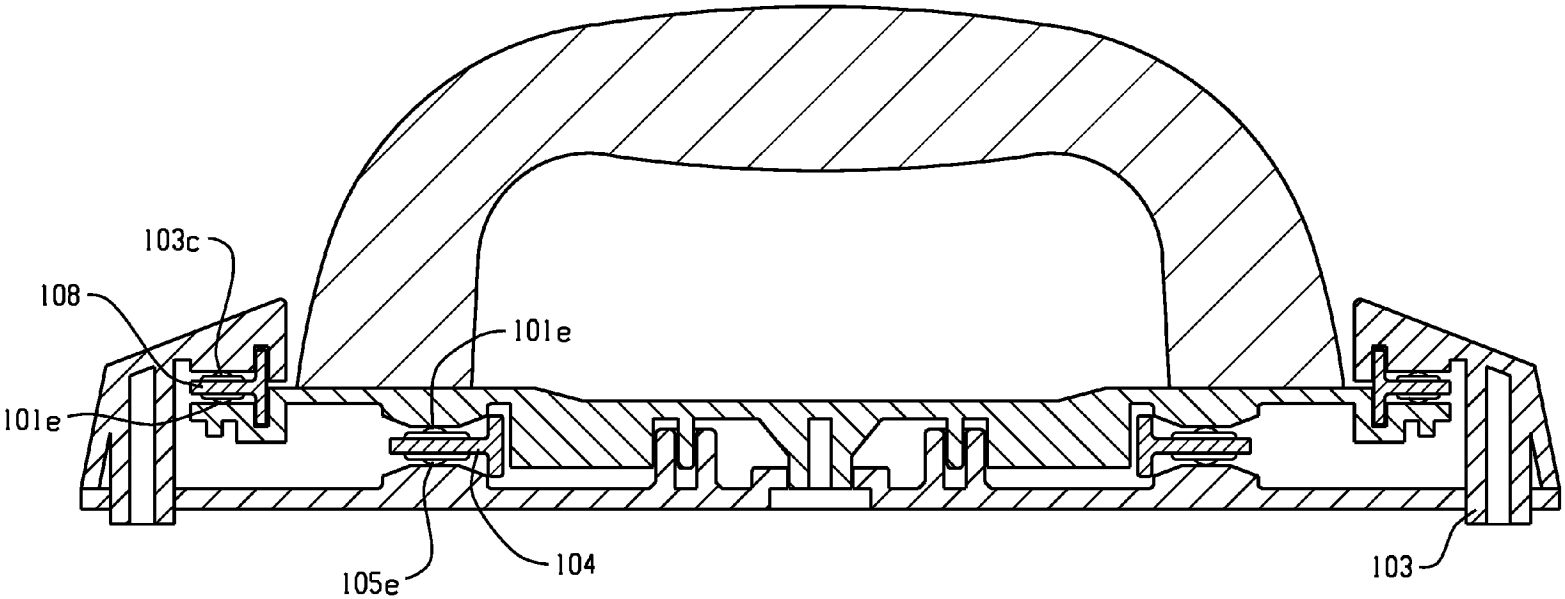
FIG. 4 depicts a cross-sectional view of the embodiment of the swivel handle of FIG. 3 with a housing.

As in the embodiment shown in FIG. 2, the swivel handle 100 may comprise a base plate 105 capable of being connected to an enclosure (not shown) and a rotatable plate 101 rotatable relative to the base plate 105. The rotatable plate 101 comprises a handle 102. The handle 102 may be integral to the rotatable plate 101 or connected separately of the rotatable plate 101. Embodiments of the handle may have at least one connection point; in some embodiments, the handle 102 comprises two points of connection as shown in FIG. 2. The rotatable plate 101 may be disposed between a housing 103 and the base plate 105. The housing 103 may be connected to the base plate 105 along a periphery and defines an aperture 103*a* through which the handle 102 may be disposed. In other embodiments, the house 103 may be connected directly to the enclosure or to an inner plate inside the enclosure. In such an embodiment, the base plate 105 may be independently connected to the enclosure 15 or merely held in place by the housing 103. The rotatable plate 101 may rotate within the space between the base plate 105 and the housing 103. With the handle protruding through the aperture 103*a* in such cases, the handle 102 may be easily grasped and swivel within the housing 103. In certain embodiments, the housing may have a surface defining the aperture 103*a*, wherein the handle protrudes through the aperture 103*a* and the surface covers a periphery portion of the rotatable plate. A bearing 108 may be disposed between the covered periphery portion of the rotatable plate 101 and an inside bearing surface 103*c* (See FIG. 4) of the housing 103.

As such, in further embodiments, the swivel handle 100 may comprise one or more bearings. The bearings are capable of improving the ability of the swivel handle 102 to rotate within the housing 103. The bearings may be located on a central axle 106, between the housing 103 and the rotatable plate 101, and/or between the base plate 105 and the rotatable plate 101. The bearings may take any desirable form including slide bearings and/or roller bearings. The roller bearings may be ball bearings or wheel bearings, for example. The swivel handle may further comprise springs capable of biasing or urging a component of the swivel handle toward or away from the bearing. Since the handle is used to pull the travel cover and its contents, an embodiment of the travel cover comprises a bearing between the rotatable plate and the housing or other component on the opposite side of the rotatable plate from the enclosure.

The embodiment of the swivel handle 100 shown in FIG. 2 has a ball bearing 104 having a plurality of balls 104*a*. In the embodiment of the swivel handle 100 shown in FIG. 2, the bearing 104 is disposed between the base plate 105 and the rotatable plate 101. The swivel handle shown in FIG. 2 further comprises a bearing 108 disposed between the rotatable plate 101 and the housing 103. The bearing 108 comprises ball bearings 108*a* that may roll along bearing surfaces on the housing 103*c* and the rotatable plate 101*e*. The bearing 108 may comprise a lower extension 108*b* that may engage a groove in the rotatable plate 101 or may comprise an upper extension 108*c* that engages a groove on the housing 103 or may comprise both extensions 108*b* and 108*c* to stabilize the bearing 108 during rotation of the handle.

Similarly, the bearing 104 may comprise balls 104*a*. The balls 104*a* may roll on the bearing surface 101*e* on the rotatable plate and 105*e* on the base plate 105. Additional embodiments may comprise bearings in other locations such as on a central axle. Further, embodiments of the swivel handle may comprise only one of the bearings described above, all of the bearings or any combination of bearings. The upper bearing 108 facilitates swiveling of the handle while the handle is being pulled to roll or otherwise move the travel cover.

Figure 5:
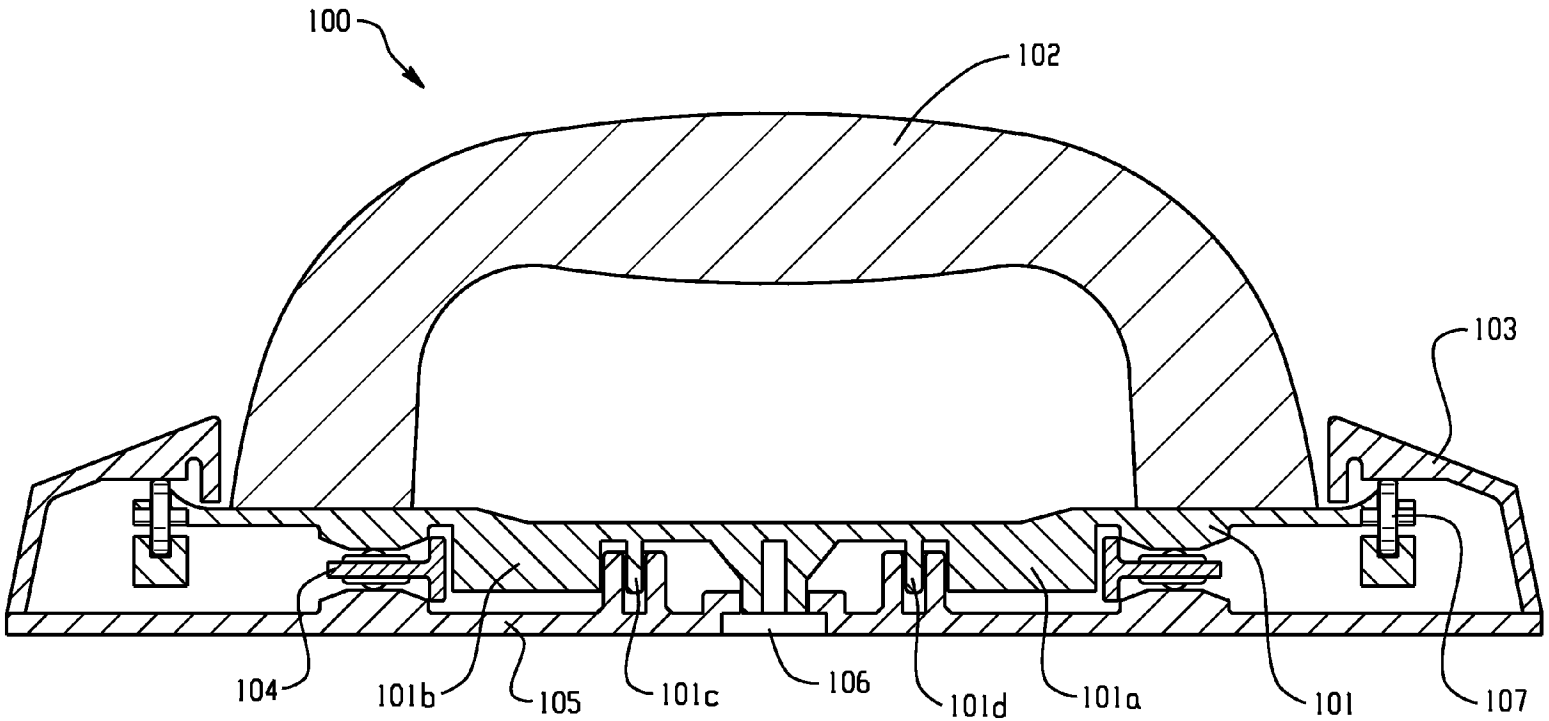
FIG. 5 depicts a cross-sectional view of another embodiment of the swivel handle wherein one set of bearings is a set of wheels connected to the rotatable plate.

Further, in the embodiment of the swivel handle of FIG. 5, the swivel handle may comprise a bearing comprising a set of wheels 107 between the rotatable plate 101 and the housing 103. The bearing 107 may be used in combination with the bearing 104 between the base plate 105 and the rotatable plate 101. In the embodiment of the travel cover shown in FIG. 5, the bearing comprising wheels 107 comprises at least three wheels rotatably connected to the rotatable plate 101, and preferably at least four wheels. The wheels 107 may be connected to the rotatable plate 101 and roll along a bearing surface on the inside of the housing 103. Thus as the travel cover is pulled, the rotatable plate 101 is pulled toward the housing 103 and the bearing 107 or bearing 108 allows the rotatable plate 101 to still easily rotate within the housing 103. In a still further embodiment, the rotatable plate 101 may be further rotatably connected to the base plate 105 by an axle 106. The axle 106 may comprise a bearing fixedly connected to the either of the base plate 105 and/or the rotatable plate 101.

Figure 3:
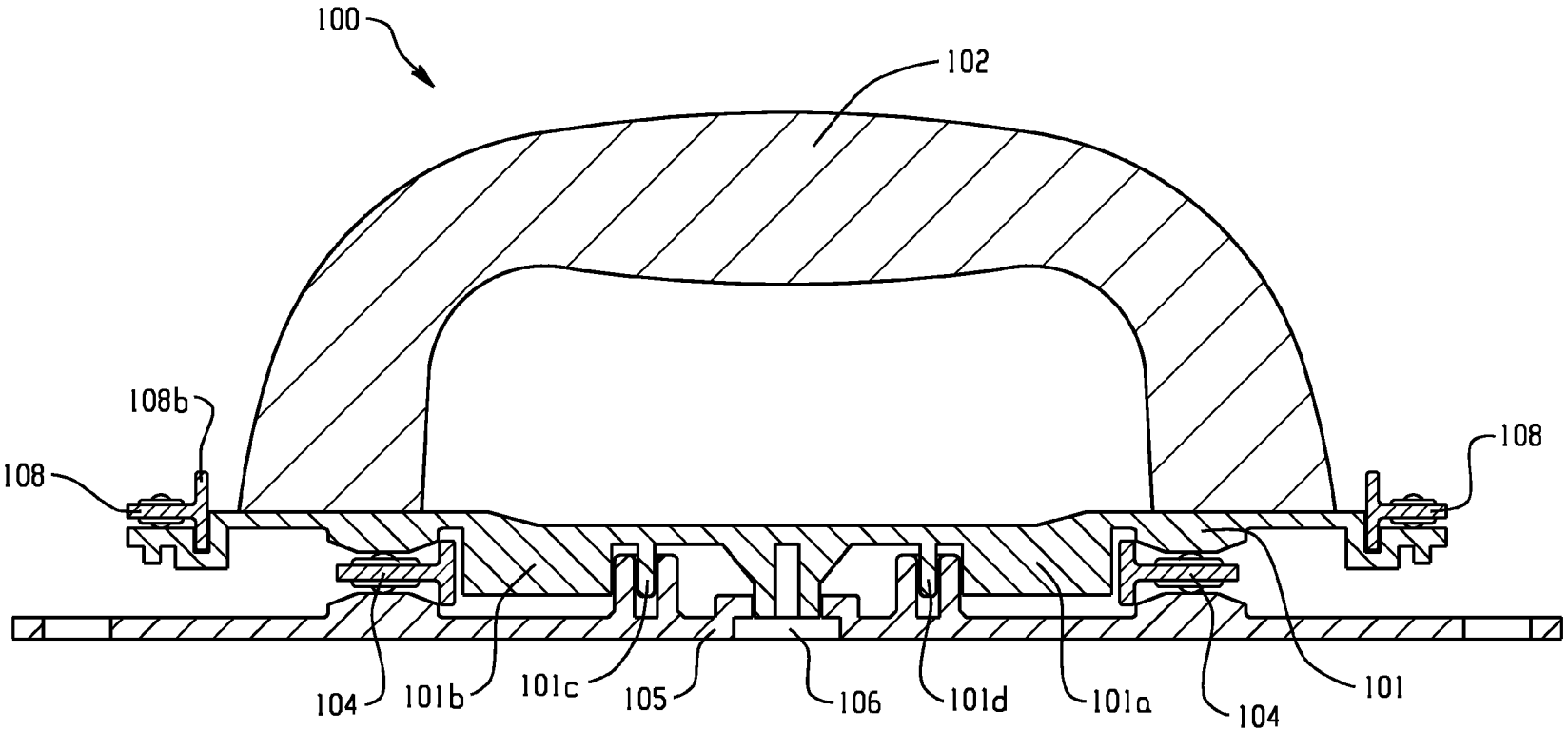
FIG. 3 depicts a cross-sectional view of an embodiment of a swivel handle without a housing.

In still further embodiments of the travel cover, the handle 102 may swivel completely around or the rotation of the handle 102 relative to a base plate 105 or the top portion of the travel cover may be limited by a combination of stops. For example, the base plate 105 and the rotatable plate 101 may comprise one or more stops that may engage one another during rotation. For example, the base plate 105 may comprise at least one stationary stop 105*a* and 105*b* and the rotatable plate may also comprise at least one rotatable stop 101*a* and 101*b*. The rotatable stop may engage the stationary stop as the handle 102 is rotated to limit further rotation of the rotatable plate relative to the base plate. In certain other embodiments, the base plate 105 may comprises two stationary stops that engage at least one rotatable stop to limit the rotation of the rotatable plate 101 in each of two directions relative to the base plate 105. The positioning of the steps may be reversed or in another configuration capable of limiting the rotation of the handles. The combination of stops interferes with the rotatable plate's 101 rotational movement to limit the rotation of the rotatable plate 101 to less than 360°. For example, in the embodiment of the swivel handle 105 in FIG. 2, the four stops 105*a* and 105*b* are integrally formed in the base plate 105. There are two corresponding stops on the bottom portion of the rotatable plate 101 (an example is shown in FIG. 3, stops 101*a* and 101*b*) that may rotate within the angle A. This combination of stops on the base plate 105 and the rotatable plate 101 limits that angular rotation of the swivel handle 102 within a desired range. For example, in certain embodiments of the swivel handle, the angular rotation of the handle may be limited to less than 360°. In other embodiments such as the embodiment of the swivel handle shown in FIGS. 2 and 3, the angular rotation A of the swivel handle 102 is limited to less than 180° and other embodiments may limit the angular rotation to less than 140°.

Further embodiments of the swivel handle may comprise a guide system for supporting and guiding the rotational movement of the swivel handle. For example, the base plate 105 and the rotatable plate 191 or the housing 102 and the rotatable plate 101 may comprise interlocking components that guide the rotational movement of the swivel handle 102. In the embodiments of the swivel handle shown in FIGS. 2 and 3, the base plate 105 comprises an inner ring 105*c* and an outer ring 105*d* defining an annular space between the two rings. The rotatable plate 101 comprises at least one corresponding protrusion 101*c* and 101*d* (see FIG. 3) that may be inserted in the annular space between the inner ring 105*c* and the outer ring 105*d*. The annular space will restrict the movement of the protrusion or protrusions 101*c* and/or 101*d* within a distinct range. The protrusion may be any shape including a pin, post, arc or complete circle. As one skilled in the art would understand, these features may be switched from the components shown in FIGS. 2 and 3 to the other components and still function as required.

To connect the swivel handle 100 to the enclosure 15, the base plate 105 or the housing 103 may be connected to the enclosure 15. The base plate 105 or housing 103 may be connected to the enclosure around their periphery. The base plate 105 and/or the housing 103 may be connected to the enclosure 15 by any attachment mechanism including, but not limited to, rivets, screws, bolts, adhesives, glues, stitching, or other connector. The base plate or housing may be connected directly to the top of the enclosure or may have intermediate components between the base plate or housing and the enclosure. Alternatively, if the top portion of the travel cover is a rigid material a top portion of the travel cover may act as the base plate and comprise the desired configuration. As such, the base plate 105 may be integral to the top of the enclosure of the travel cover.

Further, the swivel handle may comprise a second plate (not shown). The second plate may be installed on the inside of the enclosure. In such an embodiment, the base plate 105 may be connected to the second plate by rivets, screws, bolts or stitching to provide a more rigid support for the swivel handle 100 to the travel cover 100. A second plate may be desirable for travel covers comprising a flexible top portion or, in some cases wherein the travel cover has a rigid top portion. If the top portion or the entire travel cover comprises a rigid material, such as a rigid plastic, the second plate internal to the enclosure may not be as desirable, except in embodiments where extra support is needed for carrying and supporting heavy contents.

For some travel covers such as golf bag travel covers, there may be advantages for the travel cover to comprise a rigid top portion. Particularly, for embodiments of the travel covers for golf bags comprising golf clubs, the top portion of the travel cover may comprise a rigid top portion. The rigid top portion provides additional protection against damage during transport to the golf clubs that extend beyond the top of the golf bag. There may be other applications for travel covers that comprise a flexible portion and a rigid top portion. Other travel covers may comprise a complete rigid enclosure, for example, travel covers for tradeshow or conference displays or graphics and/or product samples may benefit from the protection provided by a rigid enclosure.

The embodiments of the described methods and travel covers with at least one swivel handle are not limited to the particular embodiments, components, method steps, and materials disclosed herein as such components, process steps, and materials may vary. Moreover, the terminology employed herein is used for the purpose of describing exemplary embodiments only and the terminology is not intended to be limiting since the scope of the various embodiments of the present invention will be limited only by the appended claims and equivalents thereof.

Therefore, while embodiments of the invention are described with reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

The invention claimed is:

1. A travel cover, comprising:

an enclosure comprising a top, a bottom and a base with wheels connected to the bottom;

a base plate connected to the top of the enclosure;

a housing connected to the base plate on a side of the base plate opposite to the enclosure;

a rotatable plate disposed between the housing and the base plate, wherein the rotatable plate is rotatable relative to the base plate;

a handle connected to the rotatable plate; and an upper bearing disposed between a periphery portion of the rotatable plate and an inside bearing portion of the housing.

2. The travel cover of claim 1, wherein the base plate is directly connected to the enclosure such that the base plate contacts the enclosure.

3. The travel cover of claim 2, wherein the base plate is circular and connected to the enclosure around a periphery of the base plate.

4. The travel cover of claim 1, wherein the base plate is integral to a rigid portion of the top of the enclosure.

5. The travel cover of claim 1, comprising at least two wheels attached to the base of the enclosure.

6. The travel cover of claim 1, wherein the enclosure comprises a flexible portion.

7. The travel cover of claim 1, wherein the top is a rigid top portion.

8. The travel cover of claim 1, comprising an inner plate on the inside of the enclosure opposite the base plate on the exterior of the enclosure.

9. The travel cover of claim 1, comprising a lower bearing disposed between the base plate and the rotatable plate and the rotatable plate is sandwiched between the upper bearing and the lower bearing.

10. The travel cover of claim 1, wherein the housing has a surface defining a circular opening, wherein the handle protrudes through the circular opening and the surface covers the periphery portion of the rotatable plate.

11. The travel cover of claim 1, wherein the rotatable plate is circular.

12. The travel cover of claim 1, wherein the handle is connected at two locations on the rotatable plate.

13. The travel cover of claim 1, wherein the enclosure comprises an opening and the opening comprises means for closing the opening.

14. The travel cover of claim 13, wherein the means for closing the opening are selected from the group comprising zipper, hook and loop, buckles, snaps, ties and buttons.

15. The travel cover of claim 1, wherein the wherein the base plate comprises at least one stationary stop and the rotatable plate comprises at least one rotatable stop, wherein the rotatable stop engages the stationary stop to limit rotation of the rotatable plate relative to the base plate.

16. The travel cover of claim 15, wherein the base plate comprises two stationary stops that engage the rotatable stop to limit the rotation of the rotatable plate in each of two directions relative to the base plate.

17. The travel cover of claim 1, wherein the handle is a non-retractable handle.

18. The travel cover of claim 17, wherein the enclosure has an overall height of over three feet and the handle is a non-retractable handle.

19. The travel cover of claim 1, wherein the upper bearing comprises ball bearings.

20. A travel cover, comprising:

an enclosure;

a base plate connected to the enclosure;

a housing connected to the base plate;

a rotatable plate secured between the base plate and the housing, the rotatable plate comprising a first side facing toward the enclosure, a second side facing away from the enclosure and a handle connected to the second side; and a bearing contacting a bearing surface on the second side of the rotatable plate and a bearing surface on an inside surface of the housing.

* * * * *